United States Patent [19]

Joannou

[11] Patent Number: 4,886,526

[45] Date of Patent: Dec. 12, 1989

[54] ELECTRONIC AIR FILTRATION SYSTEM

[76] Inventor: Costantinos J. Joannou, 8 Wright Street, Carleton Place, Ontario, Canada, K7C 4B3

[21] Appl. No.: 183,785

[22] Filed: Apr. 20, 1988

[30] Foreign Application Priority Data

Apr. 22, 1987 [CA] Canada ..... 535275

[51] Int. Cl.[4] ..... B03C 3/00

[52] U.S. Cl. ..... 55/131; 55/155

[58] Field of Search ..... 55/131, 155, 524, 514

[56] References Cited

U.S. PATENT DOCUMENTS

| | | | |
|---|---|---|---|
| 2,521,984 | 9/1950 | Lang | 55/514 |
| 2,589,463 | 3/1952 | Warburton | 183/7 |
| 3,073,094 | 1/1963 | Landgraf et al. | 55/131 |
| 3,438,180 | 4/1969 | Klouda | 55/126 |
| 3,509,696 | 5/1970 | Thompson | 55/131 |
| 3,581,462 | 6/1971 | Stump | 55/2 |
| 3,763,633 | 10/1973 | Soltis | 55/126 |
| 3,973,932 | 8/1976 | Alskog | 55/132 |
| 4,507,131 | 3/1985 | Fathauer et al. | 55/104 |
| 4,549,887 | 10/1985 | Joannou | 55/131 |

FOREIGN PATENT DOCUMENTS 1175754 10/1984 Canada .

*Primary Examiner*—Bernard Nozick

*Attorney, Agent, or Firm*—Price, Heneveld, Cooper, DeWitt & Litton

[57] ABSTRACT

In an air filtration system of the charged media type, a disposable air filter cartridge comprising first and second dielectric fibrous filter pads; and an electrically conductive screen sandwiched therebetween; said filter pads overlapping and extending outwardly beyond the perimeter of the screen to form a marginal border surrounding the screen. The cartridge may be provided with outer conductive screens or the frame within which the cartridge is housed may provide the outer screens. A variety of cartridges constructed in accordance with embodiments of the invention is disclosed, as is a variety of cartridge and frame combinations. The disposable cartridge of the invention obviates the necessity for replacing individual pads as in prior art systems and thus facilitates servicing of the filtration medium by simply replacing the cartridge.

18 Claims, 5 Drawing Sheets

ELECTRONIC AIR FILTRATION SYSTEM

The present invention relates to an electronic air filtration system of the charged media type which features a disposable filter cartridge and a filter cartridge holder which is provided with a high voltage electrode for charging the filter.

Electronic air filters of the charged media type are known as taught in U.S. Pat. No. 4,549,887 and Canadian pat. No. 1,175,754. These electronic filters are very effective, however, servicing them requires the replacement of the individual filter media pads. This is a tedious and dirty process, especially when many filters must be serviced at the same time in a large bank of filters. The present invention provides a disposable filter cartridge which fits within a permanent support frame, making it easy to service the filter without having to handle individual filter pads.

It is an object of the present invention to provide a disposable filter cartridge and filter cartridge frame for an air filtration system of the charged media type which is both simple to manufacture and easy to maintain.

The electronic air filtration system of the present invention comprises, in general, a disposable filter cartridge and a permanent cartridge holder or frame. The disposble filter cartridge consists of an inner screen of conductive material which is sandwiched between a pair of dielectric, fibrous pads. This inner screen is connected via an electrode to one side of a high voltage electrical energy source to electrostatically charge the filter cartridge. The fibrous filter pads are in turn covered by pair of conductive screens which are connected to the other side of the power supply. These outer screens may be an integral part of the disposable filter cartridge or an integral part of the support frame, depending on the particular embodiment of the invention.

Several embodiments of the present invention will hereinafter be described by way of example only and with reference to the following drawings wherein.

Figure 4:
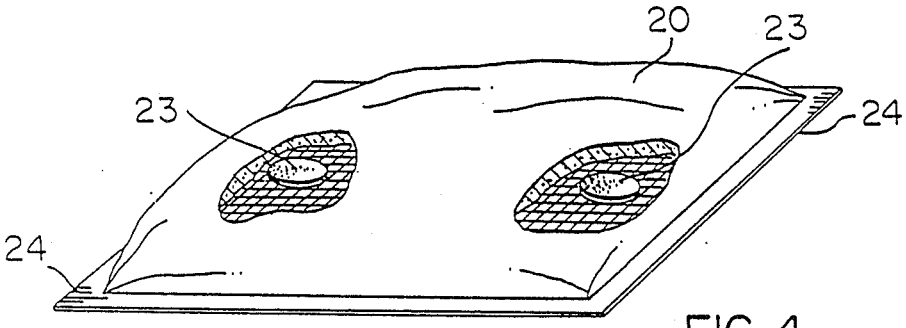
FIG. 4 is a partly broken away view of a variant of the filter cartridge of FIG. 1 wherein the outer screens are not part of the filter cartridge, the cutaway views illustrating the placement of flat disc electrodes on the surface of the inner screen.
Figure 5:
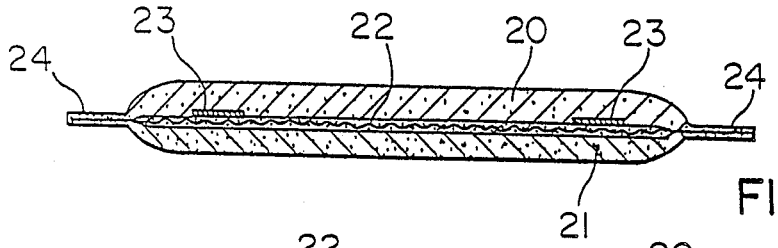
FIG. 5 is a cross-sectional view of the filter cartridge shown in FIG. 4.
Figure 5A:
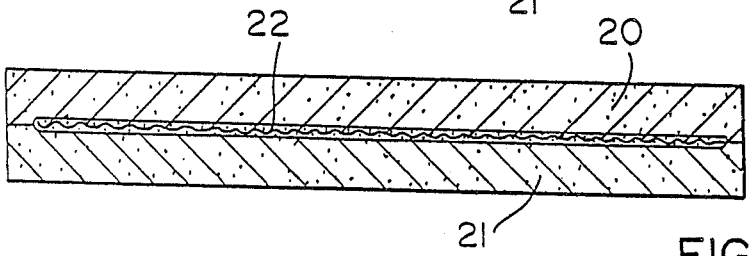
Figure 6:
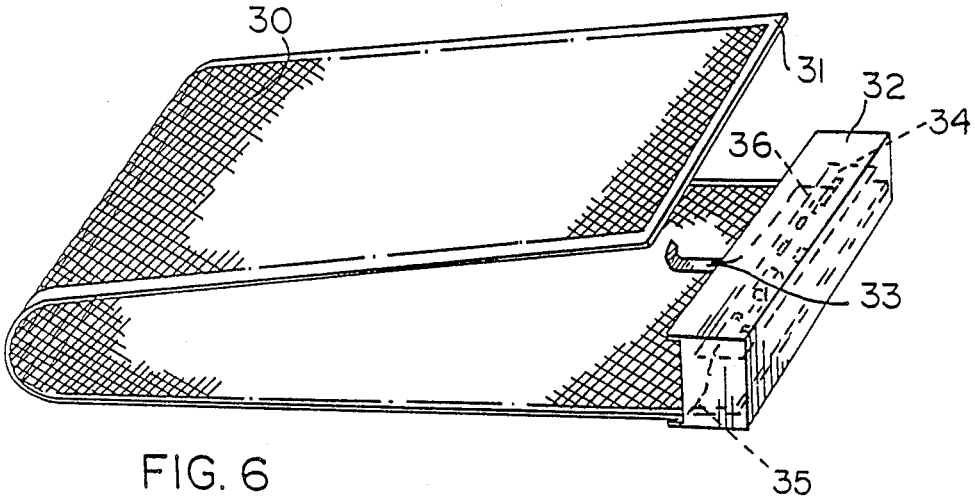

FIG. 5*a* shows a variant of the filter cartridge of FIG. 4 wherein the fibrous filter pads are glued directly to the inner screen rather than being bonded together on their perimeters;

FIG. 6 illustrates a frame for accommodating the filter cartridges of FIGS. 4, 5 and 5*a;*

Figure 7:
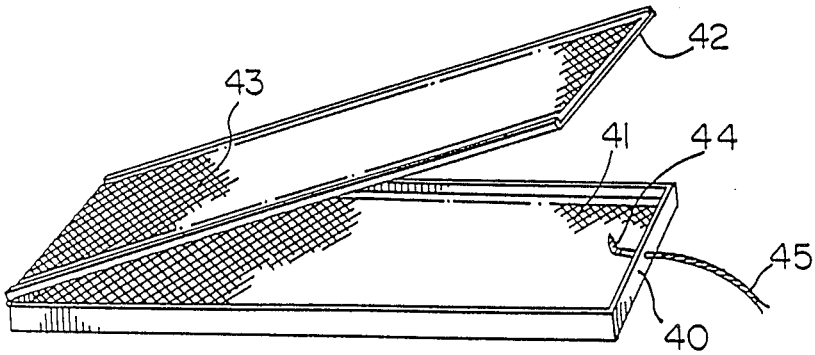

FIG. 7 shows an alternative embodiment of a frame for accommodating the filter cartridge of FIGS. 4, 5, and 5*a;*

Figure 8:
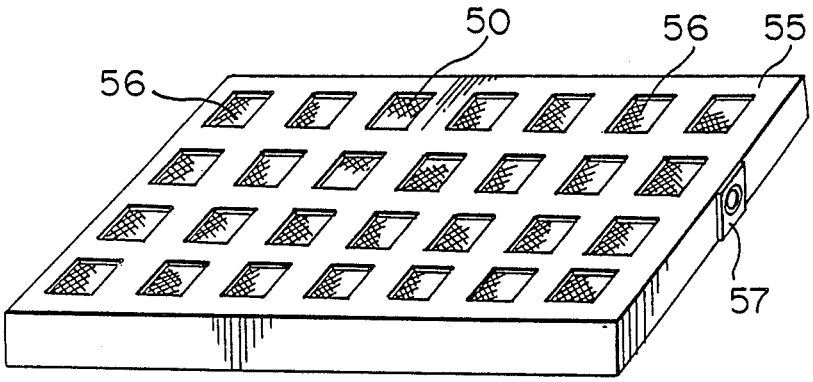
Figure 9:
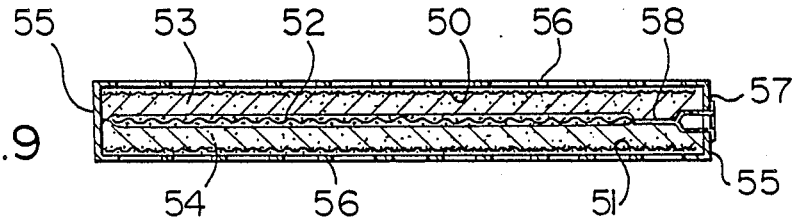
Figure 9A:
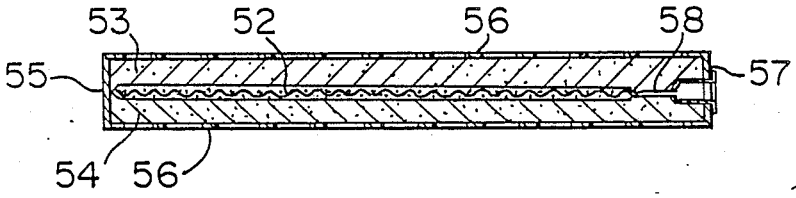
Figure 10:
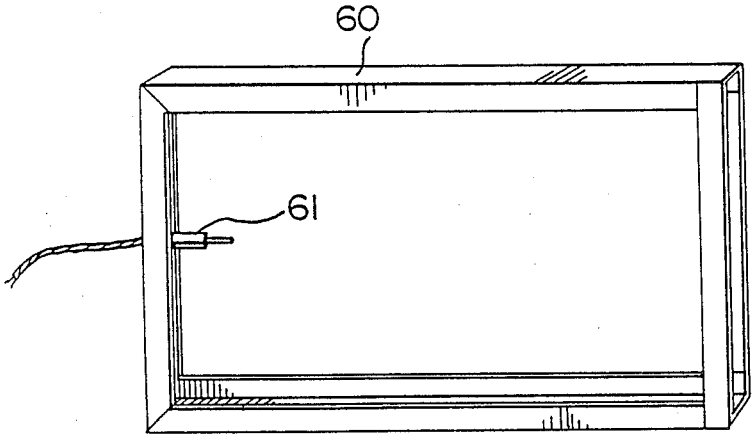
Figure 11:
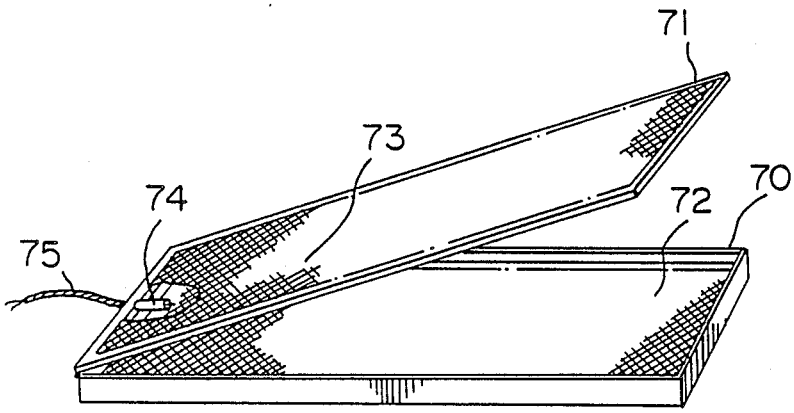
Figure 12:
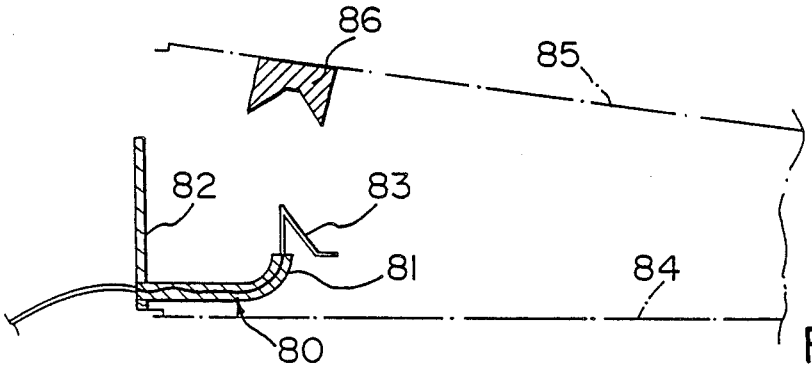
Figure 12A:
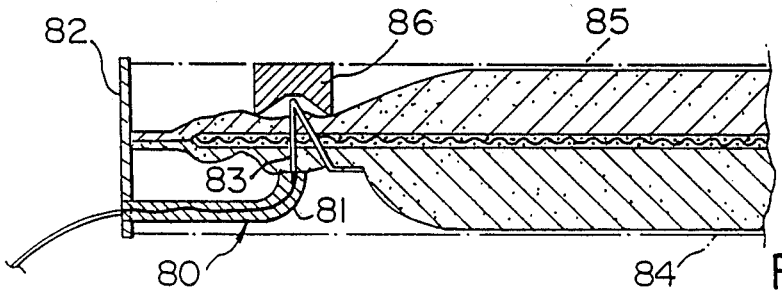
Figure 13:
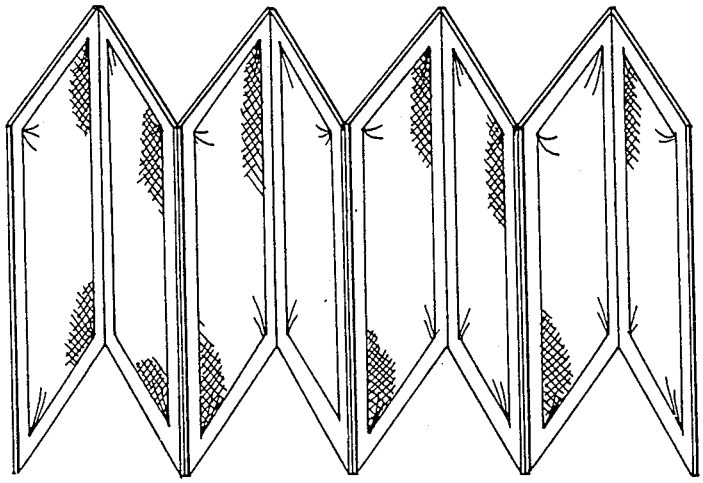
Figure 14:
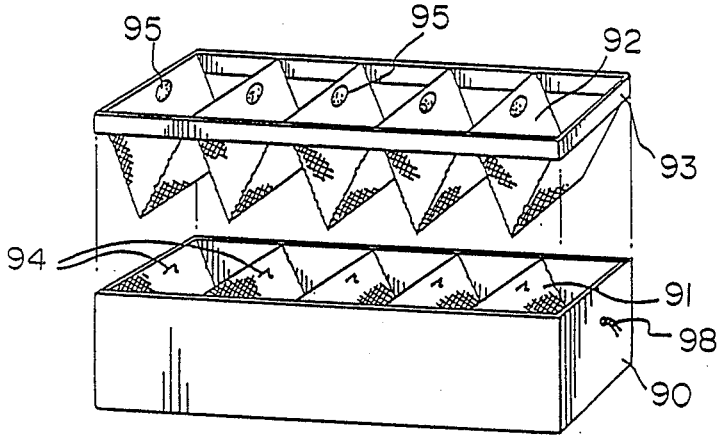
Figure 14A:
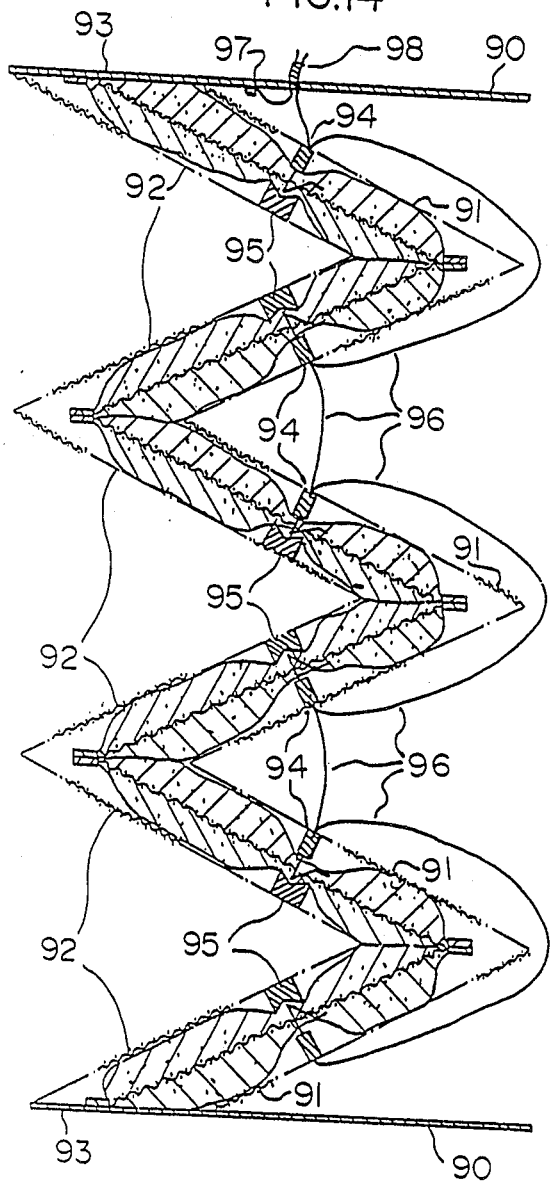

FIG. 8 illustrtes an embodiment of the filter cartridge wherein the inner screen, the fibrous filter pads and the outer screens of the filter are all housed within a perforated carton or box;

FIG. 9 is a cross-sectional view of the filter cartridge of FIG. 8;

FIG. 9*a* is a cross-sectional view of a further embodiment of the filter cartridge wherein only the inner screen and the fibrous filter pads of the filter are housed within a perforated carton or box;

FIG. 10 is a perspective view of a filter frame suitable for accommodating the filter cartridge of FIG. 8;

FIG. 11 is a perspective view of a further embodiment of a filter frame suitable for accommodating the filter cartridge of FIG. 8;

FIG. 12 is a cross-sectional view of an alternative embodiment of an electrode suitable for use with the filter frames illustrated in FIGS. 6, 7 and 11;

FIG. 12*a* is a cross-sectional view of a filter cartridge installed in a filter frame provided with the electrode of FIG. 12;

FIG. 13 illustrates a pleated filter in accordance with the invention;

FIG. 14 illustrates a frame which accommodates the pleated filter of FIG. 13; and FIG. 14*a* is a cross-sectional view of the pleated filter frame of FIG. 14 with the pleated filter of FIG. 13 installed therein and ready for use.

Figure 1:
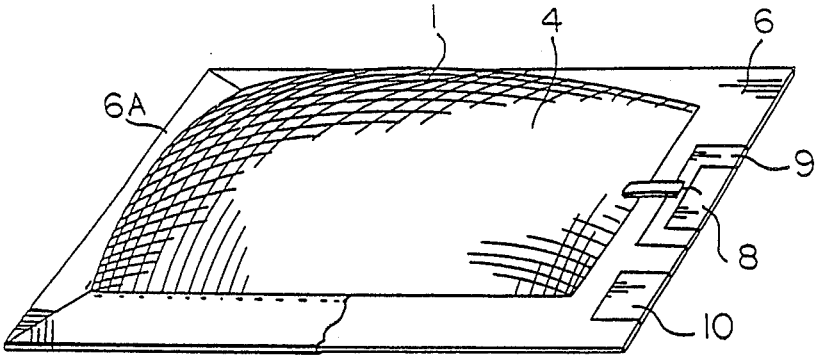
FIG. 1 illustrates a first embodiment of a filter cartridge according to the invention in which the outer screens of the filter form an integral part of the filter cartridge.
Figure 2:
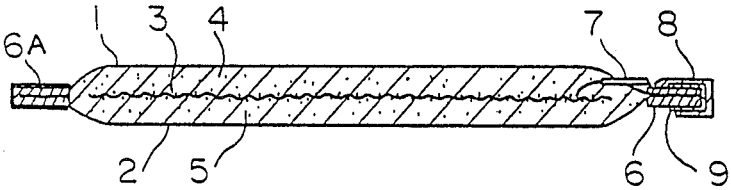
FIG. 2 is a cross-sectional view of the filter cartridge of FIG. 1.

Referring to the drawings, FIGS. 1 and 2 illustrate a first embodiment of a disposable filter cartridge of the charged media type. Electrically conductive screens 1 and 2 cover the exterior surfaces of the filter cartridge and extend to its perimeter. A third screen 3, both shorter and narrower than the outside screens, is disposed between a pair of fibrous filter pads 4 and 5 which are made of a dielectric material such as glass fibers. The fibrous filter pads 4 and 5 are the same size as outside screens 1 and 2. A border or frame 6 for the filter cartridge is formed by compressing the perimeters of outside screens 1 and 2 and filter pads 4 and 5, and applying an adhesive. Alternately, the border or frame for the filter cartridge may be formed by compressing the perimeters of outside screens 1 and 2 and filter pads 4 and 5, and applying a stitched edging 6*a* of cloth or carton ribbon. Plastic or foil edgings are also suitable for this application. Electrical power is delivered to the filter via electrodes 8 and 10 which are formed by crimping thin metallic rectangles over one end of frame 6. Electrode 10 serves as the ground contact for the filter cartridge and is, therefore, not required if filter frame 6 is covered with a conductive material in good contact with outside screens 1 and 2. If filter frame 6 is nonconductive, electrode 10 must contact both screen 1 and screen 2. Electrode 8 delivers high voltage current to inside screen 3 via insulated connector 7 which has one end in electrical contact with screen 3. If frame 6 is conductive, electrode 8 must be insulated from frame 6 by an insulator 9.

Figure 3:
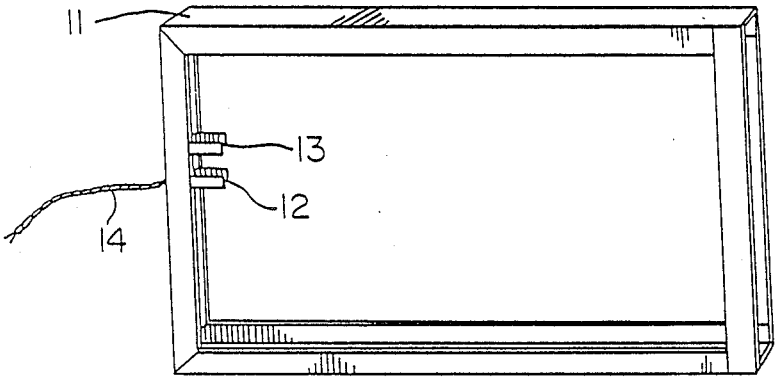
FIG. 3 shows a frame which accommodates the filter cartridge of FIG. 1.

The filter cartridge illustrated in FIGS. 1 and 2 is used in conjunction with the filter frame 11, shown in FIG. 3, which may be permanently installed in an air handling system. Filter frame 11 is constructed of channel members on its two sides and one end. The other end of frame 11 is made from flat strapping to provide an opening for the insertion and removal of filter cartridges. The closed end of frame 11 is provided with ground contact 13 and high voltage contact 12 which are connected via cable 14 to a high voltage power source. Contact 13 is connected directly to frame 11 while high voltage contact 12 is attached to frame 11 by means of an appropriate insulator. Contacts 12 and 13 are attached to filter frame 11 so that contact 12 contacts electrode 8 on the filter cartridge illustrated in FIGS. 1 ad 2 and contact 13 contacts electrode 10 when the filter cartridge is inserted into frame 11.

FIGS. 4 and 5 illustrate another embodiment of the filter cartridge shown in FIGS. 1 and 2. This embodiment of the filter cartridge is similar to the one described above with the exceptions that the filter cartridge shown in FIGS. 4 and 5 does not require outside screens nor electrodes affixed to its frame. The exterior surfaces of this filter cartridge consist of fibrous filter pads 20 and 21 disposed on each side of a conductive inside screen 22. Screen 22 is both shorter and narrower than fibrous pads 20 and 21 so that it is surrounded on all sides by an insulative layer. Affixed to each end of screen 22 are flat electrodes 23, as illustrated in the cutaway views in FIG. 4. Electrodes 23 are shown to be disc-shaped but their shape is not important. These electrodes provide a contact surface for a high voltage electrode as will be explained hereinafter in detail. The edges of fibrous filter pads 20 and 21 are compressed into a frame 24 for the filter cartridge using the same techniques as described above for the filter cartridge of FIGS. 1 and 2.

FIG. 5*a* is a cross-section of another embodiment of the filter cartridge shown in FIGS. 4 and 5. In this embodiment, fibrous filter pads 20 and 21 are glued one to the other and to the inside conductive screen 22. The edges of the filter cartridge are not compressed into a filter cartridge frame as in the previous embodiment, nor are there flat electrodes affixed to the inside screen 22. This embodiment of the filter cartridge is designed for use with a filter frame and high voltage electrode which are described in detail hereinafter.

FIG. 6 illustrates an embodiment of a filter frame designed for use with the filter cartridge of FIGS. 4 and 5. A long flexible subframe 31 attached about the perimeter of a long screen 30 is bent about the mid-point of its long dimension into a U-shape. One edge of the U-shaped subframe 31 is attached to a projection along the bottom edge of an elongated housing 32. Housing 32 contains a high voltage power supply 34, the ground wire 35 of the power supply being connected to screen 30 while the high voltage wire 36 of the power supply is connected to an L-shaped electrode 33. Electrode 33 is attached to but insulated from housing 32, the insulation extending along the length of electrode 33 to the point where the electrode turns upward to form a point. To prepare the filter unit for use, the filter cartridge illustrated in FIGS. 4 and 5 is inserted into the filter frame between the two inside surfaces of screen 30 and the top edge of subframe 31 is pressed downward and latched under a lip projecting from the top surface of housing 32. Pressing the filter cartridge downward with subframe 31 and screen 30 forces the electrode 33 upward through fibrous pad 20 to contact one of the flat electrodes 23 attached to the inside screen 22 of the filter cartridge. Electrodes 23 are provided at each end of the filter cartridge to permit the cartridge to be inserted into the filter frame with either end pointing inwards. The high voltage power supply contained in housing 32 is supplied with electrical current by a power supply line which is not illustrated.

In FIG. 7 an alternate embodiment of the filter frame of FIG. 6 is shown. This embodiment comprises a shallow tray 40 and a lid 42, each supporting a conductive screen 41 and 43 respectively. Lid 42 is hinged along one end to the tray 40. High voltage electrode 44 is connected to a high voltage power supply via electric cable 45. The ground wire of electric cable 45 is attached to tray 40. All parts of this filter frame are preferably constructed of electrically conductive material. L-shaped electrode 44 is attached to but insulated from tray 40 and engages the electrode of the inside screen of the filter cartridge in the same manner as described above for the filter frame of FIG. 6.

Figure 9B:
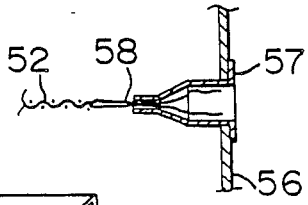

FIGS. 8 and 9 illustrate another embodiment of a disposable filter cartridge having outer screens 50 and 51 with fibrous pads 53 and 54 therebetween sandwiching an inside screen 52. In this embodiment, all parts of the filter cartridge, including outside screens 50 and 51 are housed within a perforated carton or box 56. Carton 56 may be constructed of almost any material but is most economically constructed of cardboard or the like. Perforations 56 on the top and bottom surfaces of carbon 55 allow air to pass freely therethrough. Inside screen 52 is both shorter and narrower than fibrous pads 53 and 54 so that it is surrounded on all sides by an insulative fibrous layer. Fibrous filter pads 53 and 54 are covered over substantially their entire surfaces by outer screens 50 and 51 respectively. An insulator 57 is attached to one end of the filter cartridge carton and supports a high voltage electrode 58 which projects into the cartridge to contact inside screen 52 as illustrated in FIG. 9*b*.

A ground wire (not illustrated for clarity) is also supported by insulator 57 but insulated from high voltage electrode 58. The ground wire attaches to both outside screens 50 and 51 (also not illustrated).

FIG. 10 shows a cartridge filter frame for use with the cartridge filters of FIGS. 8 and 9. This frame is exactly like the filter frame of FIG. 3 with the exception of the probe 61. Electrode 61 is a coaxial probe, the larger diameter outer conductor being connected to the neutral line of a high voltage power supply cable and the inner, smaller diameter conductor is connected to the high voltage line of a power supply cable in a manner well known in the art. To prepare the filter for use, the disposable filter of FIGS. 8 and 9 is inserted into filter frame 60 so that electrode 61 engages insulator 57. In this embodiment, the insulator 57 is formed as a coaxial formula socket with the outer conductor connected to the outside screens 50 and 51 and the inner conductor connected to high voltage electrode 58 and hence to inside screen 52.

An alternative embodiment of the filter cartridge of FIGS. 8 and 9 is illustrated in FIG. 9*a*. In this embodiment the filter cartridge is not provided with outside screens between the fibrous filter pads and the perforated carton housing. The insulator 57 attached to one end of the carton is exactly as illustrated in FIG. 9*b*, and formed as a coaxial female socket with its centre conductor connected to high voltage electrode 58 which is in contact with inside screen 52. In other respects, this filter is identical to the disposable filter of FIGS. 8 and 9. This filter cartridge is designed to be used in conjunction with the filter cartridge frame illustrated in FIG. 11 which is a variation of the frame of FIG. 7. The filter frame of FIG. 11 comprises a shallow tray 70 and a lid 71 hinged together along the end of tray 70 which supports high voltage electrode 74. Tray 70 supports a conductive screen 72 and lid 71 supports a conductive screen 73. The high voltage line of electrical cable 75 is connected to electrode 74 which is insulated from tray 70. The ground wire of high voltage cable 75 is connected to tray 70 if trays 70 and 71 are electrically conductive, or alternatively connected directly to screens 72 and 73 if the tray 70 and lid 71 are made of nonconductive material. To prepare the filter for use, the disposable filter cartridge of FIG. 9*a* is inserted into the filter frme so that electrode 74 engages insulator 57 and contacts high voltage conductor 58. Lid 71 is then lowered to its closed position and the filter is ready for use.

An alternative high voltage electrode design is shown in cross-section in FIG. 12. This high voltage electrode 83 is designed to contact any part of the inside screen of a disposable filter cartridge, eliminating the necessity for the flat electrodes 23 affixed to the inside screen of the disposable filter cartridge of FIGS. 4 and 5. This arrangement would therefore accommodate the cartridge of FIG. 5*a*. High voltage electrode 80 comprises an insulator 81 which is attached to filter frame member 82 and an electrode element 83 shaped in the form of an inverted "V". A channel-shaped insulator block 86 is attached to the inner surface of top screen 85 and in opposed relationship to element 83. The apex of V-shaped electrode element 83 forms a sharp point which pierces the fibrous filter pads and the inside screen of a disposable filter cartridge when the cartridge is inserted in the filter frame and pressure is applied by insulator block 86 upon closing the frame. Insulator 86 serves to seat electrode element 83 and insulate it from screen 85, preventing arcing of the high voltage from electrode element 83 to screen 85. Electrode 80 may be used in combination with the filter frames shown in FIGS. 6 or 7, and with the disposable filter cartridges of FIGS. 4, 5 (minus the electrodes 23) and 5*a*. It is not suitable for use with disposable filter cartridges which are provided with outside screens that are an integral part of the cartridge, nor is it required to have flat electrodes (cf. electrodes 23 of FIGS. 4 and 5) applied to the inner screens of filter cartridges used with electrode 80.

The present invention may also be adapted to the production of pleated filters. A pleated filter constructed in accordance with the invention is shown in FIG. 13. This pleated filter is formed by connecting together an appropriate number of the filters of FIGS. 4 and 5 in the arrangement shown in FIG. 13. FIG. 14 is an exploded view of a filter frame for the pleated filters of FIG. 13. A subframe part 90 supports a pleated screen 91. Each pleat of screen 91 supports but is insulated from a high voltage electrode 94 of the type illustrated in FIG. 12 and more particularly described with reference to FIG. 14*a*. A complementary subframe 93 supports a pleated top screen 92. Each pleat in screen 92 is provided with an insulator block 95. Insulator blocks 95 are affixed to screen 92 so that they cover the points of electrodes 94 when top frame 93 is placed in its closed position - again, as is more particularly described with reference to FIG. 14A. Electrodes 94 are connected in series to the high voltage wire 96 of a high voltage electric supply cable 98. The ground wire 97 of the high voltage power cable 98 is attached to frame part 90 or alternatively to screens 91 and 92. Frame parts 90 and 93 are preferably constructed of electrically conductive materials. To prepare the filter for use, a pleated filter as in FIG. 13 is placed on the bottom pleated screen 91 of the filter holder of FIG. 14 and frame 93 is placed atop frame 90, bringing pleated top screen 92 into contact with the top surfaces of the pleated filter, to provide the arrangement illustrated by FIG. 14*a*. Pressure is then applied in turn to each insulator block 95 which forces the sharp point of electrode 94 through the fibrous filter pad on the bottom of the filter cartridge and into electrical contact with the inside screen of the filter. FIG. 14*a* shows a cross-section of a pleated filter and pleated filter holder of the invention ready for use.

The operation of each embodiment of the disposable air filter cartridges and air filter cartridge frames described heretofore is identical in principle. For purposes of illustration the operation of the embodiment of the filter cartridge shown in FIGS. 1 and 2 and then filter frame shown in FIG. 3 will be described. A high voltage of the order of 5 kv to 10 kv is applied to high voltage supply cable 14, and transmitted via electrodes 12 and 8 and the electrode of insulated connector 7 to the inside screen 3 of the filter cartridge, producing an electrostatic field between charged inside screen 3 and grounded outside screens 1 and 2. The electrostatic field thus created polarizes the fibers of dielectric fibrous pads 4 and 5 as well as any particles in the air passed through the filter. This polarization greatly enhances the attraction of air suspended particles to the fibers of the filter pads, significantly increasing the efficiency of the filter process. The particular embodiment of disposable filter cartridge and filter frame chosen for a particular air filtering application depends on the air handling system being equipped.

The embodiments of the invention in which an exclusive property or privilege is claimed are defined as follows:

1. In a charged media air filtration system, an air filter including a disposable air filter cartridge and an air filter cartridge support frame for receiving said cartridge comprising, in combination:
   - a pair of opposing electrically conductive outer screens;
   - a pair of dielectric fibrous filter pads each having side surfaces and disposed between said outer screens;
   - an electrically conductive inner screen having a peripheral edge and sandwiched between said fibrous filter pads, said filter pads overlapping one another and extending outwardly beyond the perimeter of said inner screen and including a marginal border at the peripheral edge of said screen such that said filter pads surround and insulate said inner screen;
   - electrode means piercing a side surface of at least one of said fibrous filter pads for electrically connecting said inner screen to a high voltage electrical current supply of one polarity; and
   - connecting means for electrically connecting said outer screens with a high voltage electrical current supply and having a polarity opposite that of said one polarity;
   - said air filter cartridge support frame including a frame for supporting said outer screens, said dielectric filter pads, said inner screen and said electrode and connecting means.

2. A charged media air filtration system as in claim 1 wherein said disposable air filter cartridge includes said outer screens, said first and second filter pads and said inner screen bound together in a disposable unit.

3. A charged media air filtration system as in claim 2 wherein said outer screens extend into said marginal border and said border is formed into a frame by compressing and bonding together overlapping regions of said outer screens and of said pads extending beyond the perimeter of said inner screen.

4. A charged media air filtration system as in claim 3 wherein a protective edging is applied to said border.

5. A charged media air filtration system as in claim 3 wherein said electrode means include a first electrode secured to said frame and electrically connected to said inner screen; said connecting means including a second electrode electrically connected to said outer screens; said electrodes adapted for connection across a high voltage power supply and located upon said marginal border and electrically insulated from one another.

6. A charged media air filtration system as in claim 5 wherein said border has a protective edging of dielectric material applied thereto and said electrodes are mounted on said protective edging.

7. A charged media air filtration system as in claim 5 wherein said border has a protective edging of conductive material applied thereto which forms said second electrode and said first electrode is mounted on said protective edging but is insulated therefrom.

8. A charged media air filtration system as defined in claim 5, said support frame comprising:

channel members forming the sides and one end of said frame, the walls of said channel members facing inwardly of said frame;

the second end of said frame being formed by two opposed flat members affixed at each of their ends to the opposed channel members of said sides to form an opening between said flat members for the insertion and removal of said filter cartridge;

said frame further comprising on its closed end a first contact insulated from said frame and a second contact, said contacts being adapted for connection across a high voltage power supply, and said first and second contacts positioned to respectively engage said first and second electrodes of said cartridge when said cartridge is located in said frame.

9. A charged media air filtration system as in claim 1 wherein said disposable air filter cartridge includes only said pair of dielectric fibrous filter pads and said inner screen sandwiched therebetween.

10. A charged media air filtration system as claimed in claim 9 further comprising one or more flat electrodes affixed to a surface of said inner screen; said electrode means adapted to engage one of said flat electrodes when piercing said fibrous filter pad.

11. A charged media air filtration system as in claim 9, said support frame comprising:

an elongated housing containing a high voltage power supply, said housing being provided with a first projecting lip along a bottom lengthwise edge of said housing and a second parallel projecting lip along an ajacent top lengthwise edge of said housing;

an elongated flexible, rectangular subframe supporting along its inner edges an electrically conductive screen, a first lateral edge of said subframe being secured to and extending from the bottom projecting lip of said elongated housing, and the opposed lateral edge of said subframe engaging the top projecting lip of said housing when said subframe and said screen are folded back upon themselves to form a U-shape having substantially opposed upper and lower parallel screen regions;

said high voltage power supply having neutral and high voltage output terminals;

said screen regions of said frame being electrically connected to one side of said power supply by said connecting means;

said electrode means including an electrode structure extending from said housing between said projecting lips and comprising an insulator attached to said housing and an electrode element extending therethrough, said electrode element connected within said housing to the other side of said power supply and at its opposite end extending beyond said insulator and formed into an upwardly pointing inverted V-shape; and an insulator block attached to and extending downwardly from said upper screen region of said frame when in its folded state, said insulator block located in registry with said V-shaped electrode and providing a seat for said electrode, said V-shaped electrode perforating one or both of the fibrous pads of said cartridge and electrically contacting said inner screen of said cartridge and seating upon said block, when said cartridge is located upon said frame and the frame is folded over into said U-shape with said cartridge sandwiched between the screen regions of said frame.

12. A charged media air filtration system as in claim 10 wherein said overlapping filter pads of said marginal border are compressed and bonded together in the area beyond the perimeter of said screen.

13. A charged media air filtration system as defined in claim 12 wherein said support frame includes:

an elongated housing containing a high voltage power supply, said housing being provided with a first projecting lip along a bottom lengthwise edge of said housing and a second parallel projecting lip along an adjacent top lengthwise edge of said housing;

an elongated flexible, rectangular subframe supporting along its inner edges an electrically conductive screen, a first lateral edge of said subframe being secured to and extending from the bottom projecting lip of said elongated housing, and the opposed lateral edge of said subframe engaging the top projecting lip of said housing when said subframe and said screen are folded back upon themselves to form a U-shape having substantially opposed parallel screen regions;

said high voltage power supply having neutral and high voltage output terminals;

said screen regions of said frame being electrically connected to one side of said power supply by said connecting means;

said electrode means including an L-shaped electrode extending from said elongated housing between said projecting lips and insulated from said housing, said electrode being connected to the other side of said power supply and having an uninsulated tip perforating one of said fibrous pads of said cartridge and electrically contacting one of said flat electrodes affixed to the screen of said cartridge when said cartridge is located upon said frame and the frame is folded over into said U-shape with said cartridge sandwiched between said screen regions of said frame.

14. A charged media air filtration system as defined in claim 12 wherein said support frame for said cartridge includes:

a bottom subframe in the form of a shallow tray, the bottom of said tray comprising one of said outer screens, and said tray adapted to receive said cartridge; and a top subframe which forms a lid for said tray, the top of said lid comprising the other of said outer screens and said lid being hinged to said tray along one edge;

said tray being further provided with said electrode means including an L-shaped electrode projecting inwardly from the end of said tray below said hinge, said L-shaped electrode being insulated from said tray and connected to one side of a high voltage supply and said connecting means connecting the screens of said frame to the other side of said power supply;

said L-shaped electrode having an uninsulated tip perforating one or both of said fibrous pads of said cartridge and electrically contacting one of said flat electrodes affixed to the screen of said cartridge when said cartridge is located in said tray and said lid is closed thereover.

15. A charged media air filtration system as in claim 9 wherein said overlapping filter pads of said marginal border are compressed and bonded together in the area beyond the perimeter of said screen.

16. A charged media air filtration system comprising a plurality of air filter cartridges as defined in claim 15 connected together along opposed edges to form a composite pleated cartridge.

17. A charged media air filtration system comprising a composite pleated cartridge as defined in claim 16 and a two-part mounting frame for said composite pleated cartridge, said frame comprising:

a first part having a subframe supporting a first pleated conductive screen, each pleat having an electrode comprising a portion of said electrode means mounted thereon and insulated therefrom, said electrodes being adapted for connection to one side of a high voltage power supply, and each electrode extending beyond said insulator and formed into a V-shape;

a second part having a subframe supporting a second pleated conductive screen, each pleat having an insulator block attached to and extending therefrom;

the pleated shapes of said first and second parts and said composite pleated cartridge being complementary so that said composite cartridge may be sandwiched between said first and second parts;

means for locating said parts in spaced apart relationship with said composite pleated cartridge sandwiched therebetween, said insulator blocks and said V-shaped electrodes being complementarily positioned upon the pleats of the respective parts so that an electrode is in registry with a corresponding block and perforates one or both of the fibrous pads of each pleat of the composite pleated cartridge and electrically contacts said inner screen of said pleat and seats upon the insulator block in registry therewith;

and said conductive screens of said first and second frame parts being adapted for connection to the other side of said power supply by said connecting means.

18. A charged media air filtration system as in claim 15, said support frame comprising:

an elongated housing containing a high voltage power supply, said housing being provided with a first projecting lip along a bottom lengthwise edge of said housing and a second parallel projecting lip along an adjacent top lengthwise edge of said housing;

an elongated flexible, rectangular subframe supporting along its inner edges an electrically conductive screen, a first lateral edge of said subframe being secured to and extending from the bottom projecting lip of said elongated housing, and the opposed lateral edge of said subframe engaging the top projecting lip of said housing when said subframe and said screen are folded back upon themselves to form a U-shape having substantially opposed upper and lower parallel screen regions;

said high voltage power supply having neutral and high voltage output terminals;

said screen regions of said frame being electrically connected to one side of said power supply by said connecting means;

said electrode means including an electrode structure extending from said housing between said projecting lips and comprising an insulator attached to said housing and an electrode element extending therethrough, said electrode element connected within said housing to the other side of said power supply and at its opposite end extending beyond said insulator and formed into an upwardly pointing inverted V-shape; and an insulator block attached to and extending downwardly from said upper screen region of said frame when in its folded state, said insulator block located in registry with said V-shaped electrode and providing a seat for said electrode, said V-shaped electrode perforating one or both of the fibrous pads of said cartridge and electrically contacting said inner screen of said cartridge and seating upon said block, when said cartridge is located upon said frame and the frame is folded over into said U-shape with said cartridge sandwiched between the screen regions of said frame.

* * * * *

UNITED STATES PATENT AND TRADEMARK OFFICE

CERTIFICATE OF CORRECTION

PATENT NO. : 4,886,526

DATED : December 12, 1989

INVENTOR(S) : Constantinos J. Joannou

It is certified that error appears in the above-identified patent and that said Letters Patent is hereby corrected as shown below:

Column 1, line 27:

"disposble" should be --disposable--.

Column 1, line 65:

"illustrtes" should be --illustrates--.

Column 4, lines 16 and 17:

"carbon 55" should be --carton 55--.

Column 5, line 4:

"frme" should be --frame--.

Column 6, claim 1, line 28:

"In a" should be --A--.

Column 7, claim 10, line 37: Delete "claimed".

Signed and Sealed this

Fifth Day of November, 1991

*Attest:*

HARRY F. MANBECK, JR.

*Attesting Officer*

*Commissioner of Patents and Trademarks*